US008838371B2

(12) United States Patent
Sakai et al.

(10) Patent No.: US 8,838,371 B2
(45) Date of Patent: Sep. 16, 2014

(54) DRIVING ASSISTING APPARATUS

(75) Inventors: Katsuhiro Sakai, Hadano (JP); Toshiki Kindo, Yokohama (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 725 days.

(21) Appl. No.: 12/714,728

(22) Filed: Mar. 1, 2010

(65) Prior Publication Data

US 2010/0235099 A1 Sep. 16, 2010

(30) Foreign Application Priority Data

Feb. 27, 2009 (JP) ..... 2009-046425

(51) Int. Cl.
*G06G 7/78* (2006.01)
*G08G 1/16* (2006.01)

(52) U.S. Cl.
CPC ..... *G08G 1/16* (2013.01)
USPC ..... 701/301; 701/32.2; 701/300; 701/302

(58) Field of Classification Search
None
See application file for complete search history.

(56) References Cited

U.S. PATENT DOCUMENTS

| | | | | |
|---|---|---|---|---|
| 4,833,469 | A * | 5/1989 | David | 340/901 |
| 5,332,057 | A | 7/1994 | Butsuen et al. | |
| 5,572,428 | A | 11/1996 | Ishida et al. | |
| 6,026,347 | A | 2/2000 | Schuster | |
| 6,084,508 | A | 7/2000 | Mai et al. | |
| 6,169,495 | B1 | 1/2001 | Koike | |
| 6,269,307 | B1 | 7/2001 | Shinmura et al. | |
| 6,445,308 | B1 | 9/2002 | Koike | |
| 6,571,176 | B1 | 5/2003 | Shinmura et al. | |
| 6,662,108 | B2 | 12/2003 | Miller et al. | |
| 6,926,374 | B2 | 8/2005 | Dudeck et al. | |

(Continued)

FOREIGN PATENT DOCUMENTS

| | | | |
|---|---|---|---|
| DE | 10257842 | A1 | 11/2003 |
| DE | 102005020731 | A1 | 11/2006 |

(Continued)

OTHER PUBLICATIONS

Notice of Allowance for JP2009-046425, Dispatched Apr. 19, 2011.

(Continued)

*Primary Examiner* — Fateh Obaid
(74) *Attorney, Agent, or Firm* — Gifford, Krass, Sprinkle, Anderson & Citkowski, P.C.

(57) ABSTRACT

There is a driving assisting apparatus capable of reducing a feeling of discomfort of a driver by respecting the driver's operation as much as possible in a range where an obstacle can be reliably avoided by intervention control. An ECU 2 of a driving assisting apparatus 1 includes an obstacle detecting section 22, a control course calculating section 23, a determination section 24, and an intervention control executing section 25. The obstacle detecting section 22 detects an obstacle region around a vehicle. The control course calculating section 23 calculates an intervention control course, which can be taken by the vehicle, when the intervention control is executed after the driver's operation is allowed for a predetermined time. The determination section 24 determines whether the number of intervention control courses, which do not overlap the obstacle region, is equal to or smaller than a predetermined number from the obstacle region transmitted from the obstacle detecting section 22 and the intervention control course transmitted from the control course calculating section 23. The intervention control executing section 25 executes intervention control along the intervention control course when the number of intervention control courses is the predetermined number.

4 Claims, 3 Drawing Sheets

(56) References Cited

U.S. PATENT DOCUMENTS

| | | | | |
|---|---|---|---|---|
| 7,009,503 | B2 | 3/2006 | Gross | |
| 7,167,787 | B2 | 1/2007 | Bastian et al. | |
| 7,369,941 | B2 | 5/2008 | Schiffmann et al. | |
| 7,617,048 | B2 | 11/2009 | Simon et al. | |
| 7,734,419 | B2 | 6/2010 | Kondoh | |
| 7,961,084 | B2 | 6/2011 | Aso et al. | |
| 7,966,127 | B2 * | 6/2011 | Ono et al. | 701/300 |
| 8,090,537 | B2 | 1/2012 | Nishira et al. | |
| 8,244,408 | B2 | 8/2012 | Lee et al. | |
| 2002/0087241 | A1 | 7/2002 | Nakano et al. | |
| 2002/0135467 | A1 | 9/2002 | Koike | |
| 2002/0140551 | A1 | 10/2002 | Gutta et al. | |
| 2003/0006889 | A1 | 1/2003 | Koike | |
| 2003/0009275 | A1 | 1/2003 | Koike | |
| 2003/0204299 | A1 | 10/2003 | Waldis et al. | |
| 2004/0090117 | A1 | 5/2004 | Dudeck et al. | |
| 2004/0193351 | A1 | 9/2004 | Takahashi et al. | |
| 2005/0015203 | A1 | 1/2005 | Nishira | |
| 2005/0073438 | A1 | 4/2005 | Rodgers et al. | |
| 2005/0197770 | A1 | 9/2005 | Schiffmann et al. | |
| 2005/0209766 | A1 | 9/2005 | Perisho et al. | |
| 2005/0225477 | A1 | 10/2005 | Cong et al. | |
| 2006/0111838 | A1 | 5/2006 | Hughes | |
| 2006/0247852 | A1 | 11/2006 | Kortge et al. | |
| 2007/0027597 | A1 | 2/2007 | Breuel et al. | |
| 2007/0106475 | A1 | 5/2007 | Kondoh | |
| 2007/0192006 | A1 | 8/2007 | Kimura et al. | |
| 2008/0065328 | A1 | 3/2008 | Eidehall et al. | |
| 2008/0086269 | A1 | 4/2008 | Joe et al. | |
| 2008/0192710 | A1 * | 8/2008 | Balachandran et al. | 370/338 |
| 2009/0143987 | A1 | 6/2009 | Bect et al. | |
| 2010/0030472 | A1 | 2/2010 | Kindo et al. | |
| 2010/0121576 | A1 | 5/2010 | Aso et al. | |
| 2010/0235035 | A1 | 9/2010 | Nishira et al. | |
| 2011/0015805 | A1 * | 1/2011 | Seger | 701/1 |

FOREIGN PATENT DOCUMENTS

| | | | |
|---|---|---|---|
| EP | 1898232 | A1 | 3/2008 |
| FR | 2889882 | A1 | 2/2007 |
| JP | H3-118698 | A | 5/1991 |
| JP | 7104062 | A | 4/1995 |
| JP | H8-335298 | | 12/1996 |
| JP | 9132093 | A | 5/1997 |
| JP | H10-105895 | A | 4/1998 |
| JP | H11-120488 | A | 4/1999 |
| JP | H11-126294 | A | 5/1999 |
| JP | H11-345393 | A | 12/1999 |
| JP | 2000-276696 | A | 10/2000 |
| JP | 2002260146 | A | 9/2002 |
| JP | 2004-145479 | A | 5/2004 |
| JP | 2004-240506 | A | 8/2004 |
| JP | 2004224309 | A | 8/2004 |
| JP | 2005-228264 | A | 8/2005 |
| JP | 2006154967 | A | 6/2006 |
| JP | 2006-185137 | A | 7/2006 |
| JP | 2006-185139 | A | 7/2006 |
| JP | 2006-252136 | A | 9/2006 |
| JP | 2006277256 | A | 10/2006 |
| JP | 2007034684 | A | 2/2007 |
| JP | 2007088842 | | 3/2007 |
| JP | 2007-534041 | A | 11/2007 |
| JP | 2008132867 | A | 6/2008 |
| JP | 2008308152 | | 12/2008 |
| JP | 2009-505260 | A | 2/2009 |
| JP | 2009051349 | | 3/2009 |
| JP | 2009-210239 | A | 9/2009 |
| WO | 2005/037592 | A1 | 4/2005 |
| WO | WO-2006070865 | A1 | 7/2006 |
| WO | 2007/020358 | A2 | 2/2007 |
| WO | 2009/007843 | A2 | 1/2009 |

OTHER PUBLICATIONS

Office Action of U.S. Appl. No. 12/452,395 dated Oct. 17, 2012.

Office Action dated Oct. 11, 2013 for U.S. Appl. No. 13/926,395, filed Jun. 25, 2013.

Broadhurst et al., "Monte Carlo Road Safety Reasoning", IEEE Intelligent Vehicle Symposium, No. 4, Jun. 2005, pp. 319-324.

* cited by examiner (b)

(a)

DRIVING ASSISTING APPARATUS

BACKGROUND OF THE INVENTION

1. Field of the Invention

The present invention relates to a driving assisting apparatus which avoids collision with an obstacle by intervention control.

2. Related Background Art

As a driving assisting apparatus in the related art, for example, one disclosed in Patent Document 1 (Japanese Unexamined Patent Application Publication No. 2008-132867) is known. The driving assisting apparatus disclosed in Patent Document 1 includes a braking intervention unit that avoids collision by braking and a steering intervention unit that avoids collision by a steering operation, and executes intervention control by selecting one or both of the braking intervention unit and the steering intervention unit according to the collision-avoidable distance, which changes with a difference of the relative speed of a vehicle with respect to an obstacle, and changing the start timing of intervention control according to the ease of obstacle avoidance.

SUMMARY OF THE INVENTION

In the known driving assisting apparatus, excessive intervention control is prevented by delaying the intervention start timing when it is easy to avoid an obstacle so that a feeling of discomfort of the driver is reduced. However, whether to avoid an obstacle complicatedly depends on the positions, speeds, and directions of the vehicle and other vehicles or the form of intervention control. In order to reduce the feeling of discomfort of the driver by respecting the driver's operation as much as possible while reliably avoiding an obstacle, it is essential to take the complicated situation into consideration. In the known driving assisting apparatus, it is difficult to consider the complicated situation regarding the correction of intervention start timing because a specific method for the correction of intervention start timing is not disclosed.

Therefore, it is an object of the present invention to provide a driving assisting apparatus capable of reducing a feeling of discomfort of the driver by respecting the driver's operation as much as possible in a range where an obstacle can be reliably avoided by intervention control.

The present invention is characterized in that a driving assisting apparatus, which performs driving assistance so that collision with an obstacle around a vehicle is avoided by intervention control, includes: an obstacle detecting unit that detects a region including an obstacle around the vehicle; a course calculating unit that calculates a plurality of intervention control courses, which can be taken by the vehicle, when the intervention control is executed after a driver's operation is allowed for a predetermined time; a determination unit that determines the degree of overlap of each of the intervention control courses with respect to the region including the obstacle on the basis of the region including the obstacle detected by the obstacle detecting unit and the plurality of intervention control courses calculated by the course calculating unit; and an intervention control executing unit that executes the intervention control when the determination unit determines that the number of intervention control courses not overlapping the region including the obstacle is equal to or smaller than a predetermined value.

In the driving assisting apparatus according to the present invention, a plurality of post-intervention control courses, which can be taken by the vehicle when intervention control is executed after the driver's operation is allowed for a predetermined time, are calculated. A pre-intervention control is intervention control that is executed before a driver's operation is allowed for a predetermined time and a post-intervention control is intervention control executed after a driver's operation is executed for a predetermined time. Moreover, when it is determined that the number of post-intervention control courses not overlapping the region including the obstacle is equal to or smaller than a predetermined value, the intervention control is executed before the driver's operation is allowed for a predetermined time. For example, when there is at least one post-intervention control course along which an obstacle can be avoided, it is possible to reduce a feeling of discomfort of the driver by executing the driver's operation in preference to pre-intervention control. Moreover, when reaching the limit at which effective post-intervention control cannot be performed while maintaining the driver's operation, an obstacle can be reliably avoided by executing the pre-intervention control. Accordingly, it is possible to reduce a feeling of discomfort of the driver by respecting the driver's operation as much as possible in a range where an obstacle can be reliably avoided by intervention control.

Preferably, the obstacle detecting unit detects a plurality of regions including obstacles around the vehicle, and the determination unit determines the degree of overlap of each of the intervention control courses with respect to the plurality of regions including the obstacles. In this case, the intervention control timing is determined on the basis of the number of intervention control courses through which obstacles can be avoided. Accordingly, even in a crowded traffic environment where a plurality of obstacles are present (in a situation where a plurality of vehicles travel close to the vehicle), intervention control becomes possible at appropriate intervention control timing simply by determining the degree of overlap of the intervention control course with respect to the obstacle region.

In addition, preferably, a travel state acquisition unit that acquires a travel state of the vehicle is further included, and the course calculating unit calculates the plurality of intervention control courses, which can be taken by the vehicle when the intervention control is executed, on the basis of the travel state of the vehicle acquired by the travel state acquisition unit.

In addition, preferably, the determination unit determines the degree of overlap in consideration of vehicle information regarding the vehicle, and the intervention control executing unit executes the intervention control along the intervention control course when the determination unit determines that the number of intervention control courses not overlapping the region including the obstacle is equal to or smaller than the predetermined value.

Moreover, the obstacle detecting unit, the course calculating unit, the determination unit, the intervention control executing unit, and the travel state acquisition unit are configured by an electronic control unit.

DESCRIPTION OF THE PREFERRED EMBODIMENTS

Hereinafter, an embodiment of a driving assisting apparatus according to the present invention will be described in detail with reference to the drawings.

Figure 1:
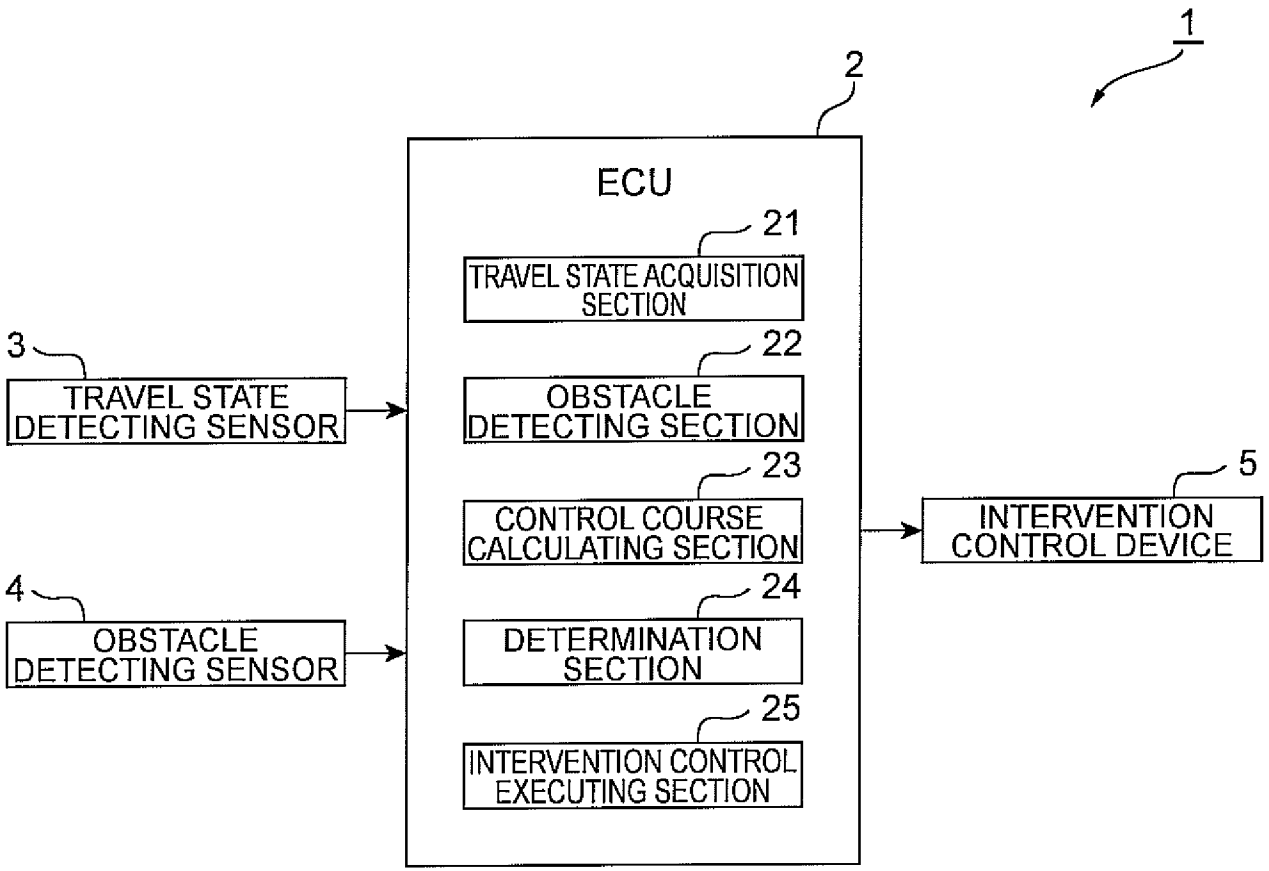
FIG. 1 is a block diagram showing the schematic configuration of a driving assisting apparatus according to an embodiment of the present invention.

FIG. 1 is a block diagram showing the schematic configuration of a driving assisting apparatus according to an embodiment of the present invention. In this drawing, a driving assisting apparatus 1 is an apparatus which determines whether or not there is intervention control effective for avoiding an obstacle after a driver's operation is allowed for a predetermined time and executes intervention control when reaching the limit at which there is no effective intervention control.

The driving assisting apparatus 1 includes an ECU (Electronic Control Unit) 2. A travel state detecting sensor 3, an obstacle detecting sensor 4, and an intervention control device 5 are connected to the ECU 2.

The travel state detecting sensor 3 is a sensor for acquiring the travel state (behavior) of a vehicle and, for example, is a speed sensor, a steering angle sensor, a brake sensor, an accelerator sensor or the like. The travel state detecting sensor 3 transmits a detection signal (travel signal) to the ECU 2.

The obstacle detecting sensor 4 is a sensor which detects an obstacle existing around the vehicle and is, for example, a millimeter wave radar, a camera or the like. The obstacle detecting sensor 4 transmits a detection signal (obstacle signal) to the ECU 2.

The intervention control device 5 is a device which executes intervention control, such as braking control or steering control, and, for example, is a brake actuator, a steering actuator or the like. The intervention control is either a pre-intervention control which is the intervention control executed before a driver's operation is allowed for a predetermined time or a post-intervention control which is the intervention control executed after the driver's operating is allowed for the predetermined time. The intervention control device 5 executes each intervention control according to the control signal (which will be described) transmitted from the ECU 2.

The ECU 2 includes a travel state acquisition section (travel state acquisition unit) 21, an obstacle detecting section (obstacle detecting unit) 22, a control course calculating section (course calculating unit) 23, a determination section (determination unit) 24, and an intervention control executing section (intervention control executing unit) 25.

The travel state acquisition section 21 acquires the travel state of the vehicle on the basis of the travel signal transmitted from the travel state detecting sensor 3. Specifically, the travel state acquisition section 21 acquires the vehicle speed of the vehicle from a travel signal transmitted from a speed sensor, for example. The travel state acquisition section 21 transmits the travel state information indicating the acquired travel state to the control course calculating section 23.

The obstacle detecting section 22 detects a region including an obstacle (hereinafter, referred to as an obstacle region) around the vehicle on the basis of an obstacle signal transmitted from the obstacle detecting sensor 4. The obstacle is another vehicle which travels around the vehicle, for example. Specifically, the obstacle detecting section 22 acquires the information, such as the position or speed of another vehicle around the vehicle, on the basis of the obstacle signal transmitted from the obstacle detecting sensor 4, for example, and predicts the course of another vehicle on the basis of the acquired information. In addition, the obstacle detecting section 22 detects an obstacle region including a predetermined range in the course direction (movement distance of another vehicle for a predetermined time when another vehicle travels at the speed acquired by the obstacle detecting sensor 4). The obstacle detecting section 22 transmits the obstacle information indicating the detected obstacle region to the determination section 24.

On the basis of the travel state information transmitted from the travel state acquisition section 21, the control course calculating section 23 calculates a pre-intervention control course (locus) that the vehicle can take by executing the intervention control before a driver's operation is allowed for a predetermined time. Specifically, when each pre-intervention control (for example, braking control, steering control or the like) that the vehicle can execute at that point of time (i.e. before a driver's operation is allowed for a predetermined period of time) is executed after the driver's operation (driving) is allowed for a predetermined time, the control course calculating section 23 calculates a plurality of post-intervention control courses acquired by performing the intervention control after the driver's operation is allowed for a predetermined period of time. This intervention control course is calculated on the basis of a random number or a fixed pattern set beforehand, and the intervention control is executed either before a driver's operation is allowed for a predetermined time as the pre-intervention control or the intervention control is executed after a driver's operation is allowed for a predetermined time as a post-intervention control. The control course calculating section 23 transmits the control course information indicating the calculated intervention control course to the determination section 24. In addition, the predetermined time is a time including delay of the intervention control.

The determination section 24 determines the degree of overlap of the intervention control course with respect to the obstacle region, in consideration of the vehicle information (vehicle width and the like) regarding the vehicle, on the basis of the obstacle information transmitted from the obstacle detecting section 22 and the control course information transmitted from the control course calculating section 23. Specifically, the determination section 24 determines whether the number of post-intervention control courses, which do not overlap the obstacle region, is equal to or smaller than a predetermined number. The predetermined number is a number set arbitrarily and is set to 1, for example. The determination section 24 transmits the determination information indicating the determination result to the intervention control executing section 25.

The intervention control executing section 25 transmits a control signal, which instructs the execution of intervention control either as the pre-intervention control (which is the intervention control executed before the driver's operation is allowed for the predetermined time) or the post-intervention control (which is the intervention control which is executed after the driver's operation is allowed for the predetermined time), to the intervention control device 5 on the basis of the determination information transmitted from the determination section 24. Specifically, when the determination information transmitted from the determination section 24 indicates that the number of post-intervention control courses not overlapping the obstacle region is equal to or smaller than the predetermined number, the intervention control executing section 25 instructs the execution of pre-intervention control (which is executed before a driver's operation is allowed for the predetermined time) along the intervention control course which can be executed at that point of time.

Figure 2:
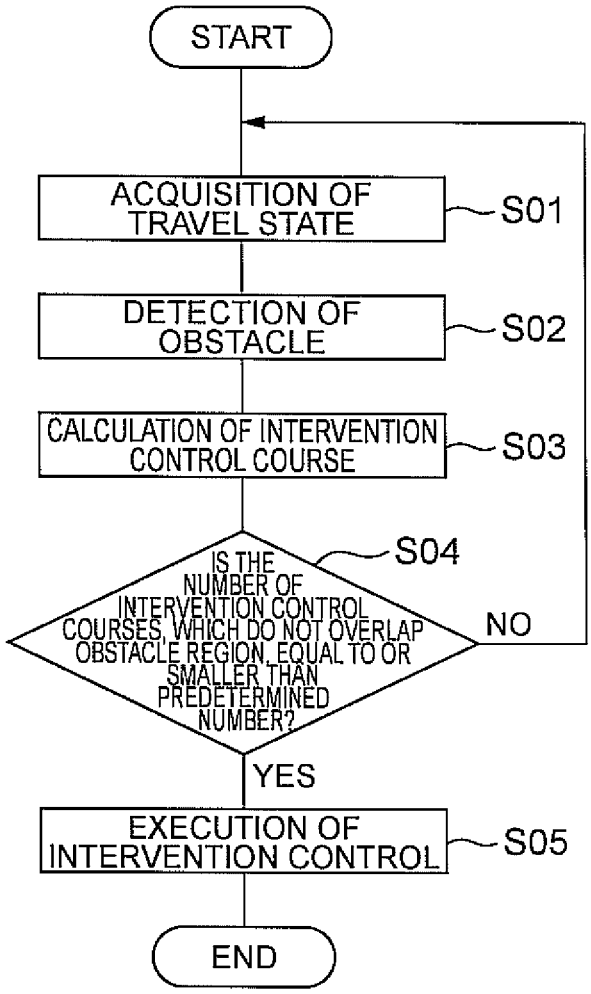
FIG. 2 is a flow chart showing the details of the procedure of an operation executed by an ECU.

FIG. 2 is a flow chart showing the details of the procedure of an operation executed by the ECU 2.

In FIG. 2, first, the travel state of a vehicle is acquired on the basis of the travel state information transmitted from the travel state detecting sensor 3 (step S01). Then, the obstacle region around the vehicle is detected on the basis of the obstacle information transmitted from the obstacle detecting sensor 4 (step S02).

Figure 3:
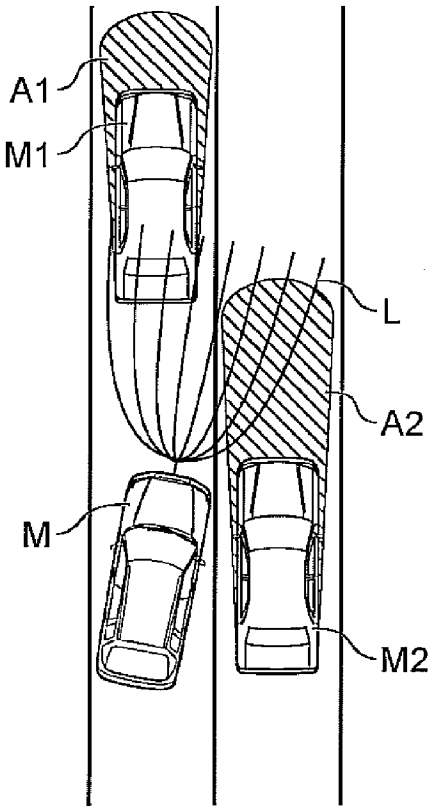
FIG. 3 is a view showing an example of an intervention control course with respect to an obstacle region.
Figure 3:
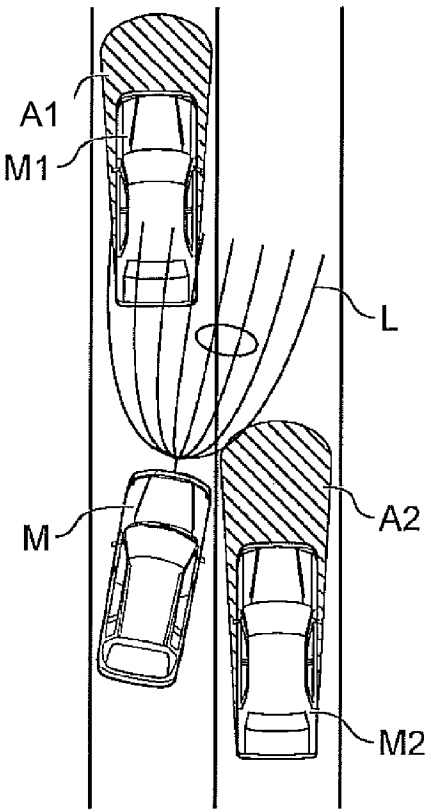

Then, a plurality of post-intervention control courses of the vehicle when the intervention control is executed after the driver's operation is allowed for a predetermined time are calculated on the basis of the acquired travel state of the vehicle (step S03). Then, on the basis of the obstacle region and each intervention control course, it is determined whether the number of post-intervention control courses, which do not overlap the obstacle region, is equal to or smaller than a predetermined number (step SO4). The specific determination method will be described with reference to FIG. 3.

For example, as shown in FIG. 3A, when there are two post-intervention control courses L not overlapping a first region A1 including a vehicle M1 traveling around a vehicle M and a second region A2 including a vehicle M2 traveling around the vehicle M among a plurality of post-intervention control courses that the vehicle M can take for the first and second regions A1 and A2, it is determined that the number of post-intervention control courses not overlapping the obstacle regions is not equal to or smaller than a predetermined number. On the other hand, as shown in FIG. 3B, when there is no post-intervention control course L not overlapping the first region A1 including the vehicle M1 traveling around the vehicle M and the second region A2 including the vehicle M2 traveling around the vehicle M, it is determined that the number of post-intervention control courses not overlapping the obstacle regions is equal to or smaller than the predetermined number. When it is determined that the number of post-intervention control courses L not overlapping the obstacle regions is equal to or smaller than the predetermined number, pre-intervention control along the intervention control course L is executed before the driver's operation is allowed for the predetermined time (step S05). On the other hand, when it is determined that the number of post-intervention control courses L not overlapping the obstacle regions is not equal to or smaller than the predetermined number, the process returns to step SO1 to repeat the processing.

As described above, in the driving assisting apparatus 1 of the present embodiment, a plurality of post-intervention control courses, which can be taken by the vehicle when post-intervention control is executed after the driver's operation is allowed for a predetermined time, are calculated. Moreover, when it is determined that the number of post-intervention control courses not overlapping an obstacle region is equal to or smaller than a predetermined number, the intervention control device 5 executes pre-intervention control before the driver's operation is allowed for the predetermined time. When there is at least one post-intervention control course along which other vehicles around the vehicle can be avoided, it is possible to avoid the other vehicles even after continuing the current driver's operation for a predetermined time. Accordingly, when there is at least one intervention control course along which an obstacle can be avoided, it is possible to reduce a feeling of discomfort of the driver by executing the driver's operation in preference to pre-intervention control.

Moreover, since the intervention control device 5 executes pre-intervention control when reaching the limit at which effective intervention control cannot be performed while maintaining the driver's operation (for example, when there is no post-intervention control course), an obstacle can be reliably avoided. Accordingly, it is possible to reduce a feeling of discomfort of the driver by respecting the driver's operation as much as possible in a range where an obstacle can be reliably avoided by intervention control. As a result, it is possible to execute appropriate driving assistance while ensuring the driver's pleasure in driving.

Moreover, in the present embodiment, obstacle regions including a plurality of other vehicles around a vehicle are detected, and it is determined whether or not the number of post-intervention control courses not overlapping the plurality of obstacle regions is equal to or smaller than a predetermined number. Accordingly, even in a crowded traffic environment such as a situation where a plurality of other vehicles travel close to the vehicle, the necessary minimum intervention control can be executed with a simple configuration.

The present invention is not limited to the embodiment described above. For example, although the pre-intervention control is executed when the number of post-intervention control courses not overlapping the obstacle region is equal to or smaller than a predetermined number in the embodiment described above, the pre-intervention control may also be executed when there is no post-intervention control course or when the rate of post-intervention control course is equal to or smaller than a predetermined rate.

What is claimed is:

1. A driving assisting apparatus which performs driving assistance so that collision with an obstacle around a vehicle is avoided by a pre-intervention control which is an intervention control executed before a driver's operation is allowed for a predetermined time, comprising:

an obstacle detecting unit that detects a region including an obstacle around the vehicle;

a course calculating unit that calculates a plurality of post-intervention control courses, which can be taken by the vehicle, when a post-intervention control is executed after a driver's operation is allowed for the predetermined time, the post-intervention control is the intervention control executed after the driver's operation is allowed for the predetermined time;

a determination unit that determines a degree of overlap of each of the post-intervention control courses with respect to the region including the obstacle on the basis of the region including the obstacle detected by the obstacle detecting unit and the plurality of post-intervention control courses calculated by the course calculating unit, and the determination unit determines the degree of overlap in consideration of vehicle information on the vehicle; and an intervention control executing unit that executes the pre-intervention control along an intervervention control course when the determination unit determines that the number of post-intervention control courses not overlapping the region including the obstacle is equal to or smaller than a predetermined value.

2. The driving assisting apparatus according to claim 1, wherein the obstacle detecting unit detects a plurality of regions including obstacles around the vehicle, and the determination unit determines the degree of overlap of each of the post-intervention control courses with respect to the plurality of regions including the obstacles.

3. The driving assisting apparatus according to claim 1, further comprising:

a travel state acquisition unit that acquires a travel state of the vehicle, wherein the course calculating unit calculates the plurality of post-intervention control courses, which can be taken by the vehicle when the post-intervention control is executed, on the basis of the travel state of the vehicle acquired by the travel state acquisition unit.

4. The driving assisting apparatus according to claim 3, wherein the obstacle detecting unit, the course calculating unit, the determination unit, the intervention control executing unit, and the travel state acquisition unit are formed by an electronic control unit.

* * * * *